US005906496A

United States Patent [19]

DelPrete et al.

[11] Patent Number: 5,906,496

[45] Date of Patent: May 25, 1999

[54] MINIATURE CARD EDGE CLIP

[75] Inventors: Stephen D. DelPrete, Rehoboth; David M. Barnum, South Dartmouth, both of Mass.; Luis A. Sousa, Cranston, R.I.

[73] Assignee: Thomas & Betts International, Inc., Sparks, Nev.

[21] Appl. No.: 08/771,978

[22] Filed: Dec. 23, 1996

[51] Int. Cl.[6] ..... H01R 4/66

[52] U.S. Cl. ..... 439/95; 439/92

[58] Field of Search ..... 439/92, 95, 861

[56] References Cited

U.S. PATENT DOCUMENTS

| | | | |
|---|---|---|---|
| 3,528,050 | 9/1970 | Hindenburg | 439/92 |
| 3,902,776 | 9/1975 | Williams et al. | 439/885 |
| 4,029,384 | 6/1977 | Reinwall, Jr. | 439/92 |
| 4,979,903 | 12/1990 | Gosselin | 439/78 |
| 5,011,416 | 4/1991 | Gladden, Jr. et al. | 439/98 |
| 5,188,535 | 2/1993 | Bertho et al. | 439/83 |
| 5,451,167 | 9/1995 | Zielinski et al. | 439/92 |

*Primary Examiner*—Gary F. Paumen

*Attorney, Agent, or Firm*—Weingarten, Schurgin, Gagnebin & Hayes LLP

[57] ABSTRACT

An edge clip is disclosed for electrically connecting a conductive pad on the surface of a printed circuit board or its edge to an external connector. The edge clip is substantially U-shaped, with first and second opposing, non-parallel sides defining a space therebetween. For connection, the printed circuit board edge is fitted into the space such that the opposing sides provide spring-like deflective force against the pad and the printed circuit board, thereby providing a more reliable connection. The edge clip may include an alignment feature for facilitating alignment prior to soldering. The alignment feature may include small projections formed on the edge clip to align with, and fit into, holes on the print circuit board. Scored sections may be disposed on one edge of the clip to facilitate removal of the edge clip from a carrier during assembly. Further, the edge clip may include a center beam extending away from one of the opposing surfaces to provide contact with another metallic surface, such as a miniature card case, thereby providing additional grounding capabilities which can provide protection against static discharge.

8 Claims, 4 Drawing Sheets

MINIATURE CARD EDGE CLIP

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The use of removable, self-contained electronic devices such as memory cards designed according to the MCIF Specification is known. Such devices offer advantages because of their relatively convenient size, typical plug and play compatibility and ease of removal, among other things. However, these advantages are dependent upon providing reliable electrical connection between the removable device and the host device. It is therefore desirable to have small, reliable connectors for interfacing such removable devices and host devices.

BRIEF SUMMARY OF THE INVENTION

An edge clip is disclosed for providing an electrical pathway between a conductive pad on the surface of a miniature card printed circuit board and an external connector proximate to the edge of the printed circuit board. The edge clip includes first and second opposing, non-parallel, planar members defining a space therebetween. For connection purposes, the printed circuit board is fitted into the space. The opposing sides then provide spring-like deflective force against the pad and the printed circuit board, thereby providing a more reliable connection. The planar members provide spring-like deflective force against the pad and printed circuit board because, in an undeflected state, the space defined between the opposing members is less than the thickness of the printed circuit board. In order to secure the edge clip in place more permanently the clip may subsequently be soldered to the pad. A connecting member disposed between the first and second opposing members is then placed in electrical connection with an external connector in order to provide connectivity between the printed circuit board an external device.

The edge clip may also include an alignment feature for facilitating alignment of the edge clip with respect to the printed circuit board pad. The alignment feature is an interlocking protrusion and recess. While the protrusion may be formed on either the printed circuit board or the edge clip, in the preferred embodiment the protrusion is formed on the malleable legs of the edge clip by bending or stamping to provide bumps which will align with the corresponding holes formed in the printed circuit board.

The edge clip may also include a center beam which extends away from the clip to provide electrical contact with a feature other than the printed circuit board pad and the external contact. For example, a center beam can be employed to deflect against a miniature card metal housing to provide protection against damaging static discharge.

Alternatively, the edge clip may include a planar body section having location leads and a planar edge section extending respectively from distal ends thereof. The planar edge section and the body section are approximately perpendicular and are connected by a rounded edge. The leads and the body section are also approximately perpendicular and connected by a rounded edge. The location leads facilitate positioning the edge clip on a printed circuit board. More particularly, position locating holes are drilled in the printed circuit board prior to installation of the edge clip and the edge clip is mounted on the printed circuit board by inserting the leads into the locating holes such that the planar edge section is proximate to the edge of the printed circuit board. The edge clip can then be more securely attached to the printed circuit board by means such as soldering.

BRIEF DESCRIPTION OF THE SEVERAL VIEWS OF THE DRAWING

The present invention will be more fully understood from the following detailed description of the drawing, in which.

DETAILED DESCRIPTION OF THE INVENTION

Figure 1:
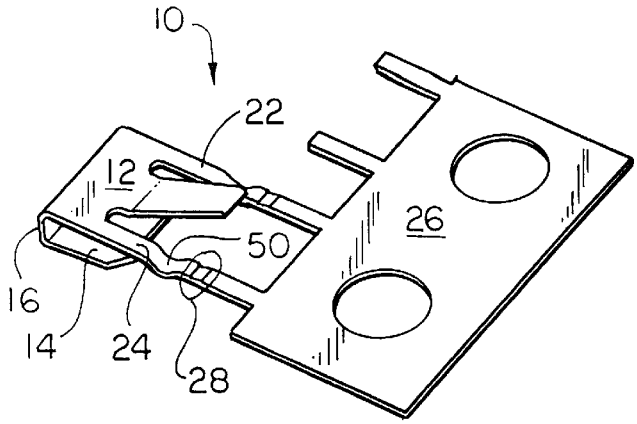
FIG. 1 is a perspective view of a miniature card edge clip.
Figure 2:
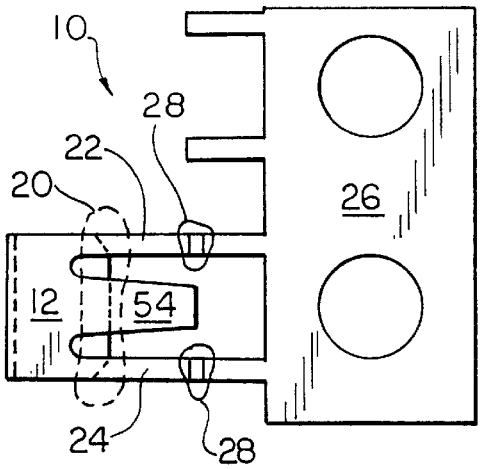
FIG. 2 is a top view of the edge clip of FIG. 1.
Figure 4:
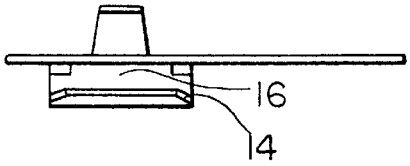
FIG. 4 is a front view of the edge clip of FIG. 1.
Figure 3:
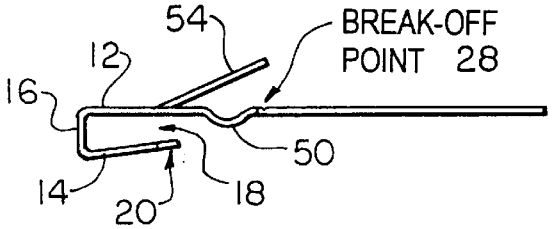
FIG. 3 is a side view of the edge clip of FIG. 1.

Referring now to FIGS. 1–4, a U-shaped edge clip 10 suitable for use in conjunction with a miniature card printed circuit board is illustrated. The edge clip includes a first planar member 12 and a second planar member 14 which are joined by a connecting member 16. The first and second planer members are non-parallel, defining a space 18 therebetween. More particularly, the planar members are offset by from 5 . 15 degrees, and the space defined therebetween is greatest adjacent the connecting member, decreasing toward an end 20 distal to the connecting member.

The edge clip also includes first and second legs 22, 24 which extend from the first planar member. More particularly, the first and second legs extend from opposite sides of the first planar member and, prior to installation of the edge clip on a printed circuit board, are connected to a clip carrier 26. In order to facilitate removal of the edge clip from the clip carrier, a scored breakaway section 28 is formed at the interface between the edge clip and the clip carrier such that the edge clip easily breaks away from the clip carrier at the scored section when the edge clip and carrier are bendably moved relative to one-another.

Figure 5:
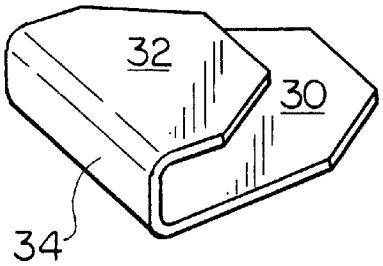
FIG. 5 is a perspective view of an alternative embodiment of the edge clip.
Figure 6:
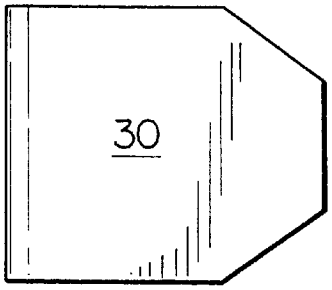
FIG. 6 is a top view of the edge clip of FIG. 5.
Figure 7:
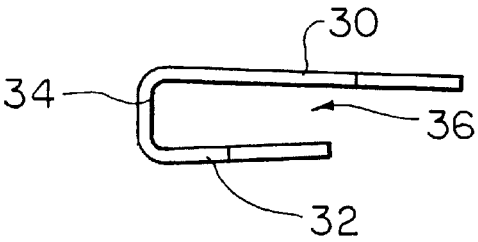
FIG. 7 is a side view of the edge clip of FIG. 5.
Figure 8:
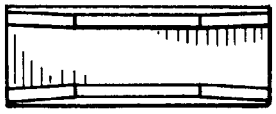
FIG. 8 is a front view of the edge clip of FIG. 5.

Referring now to FIGS. 5–8, in an alternative embodiment the edge clip includes upper and lower planar members 30, 32 which are connected by a connecting member 34. The upper and lower planar members are non-parallel and define a space 36 therebetween which decreases from the cross member to the distal end of the lower planar member. As such, the edge clip squeezably deflects against the edge of a printed circuit board when mounted thereto, and tends to remain in a fixed position prior to soldering thereto.

Figure 9:
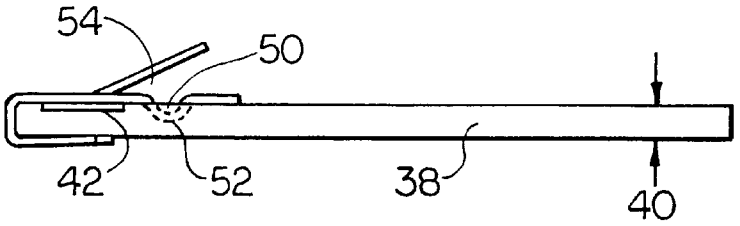
FIG. 9 is a side view of the edge clip of FIG. 1 connected to a printed circuit board.
Figure 10:
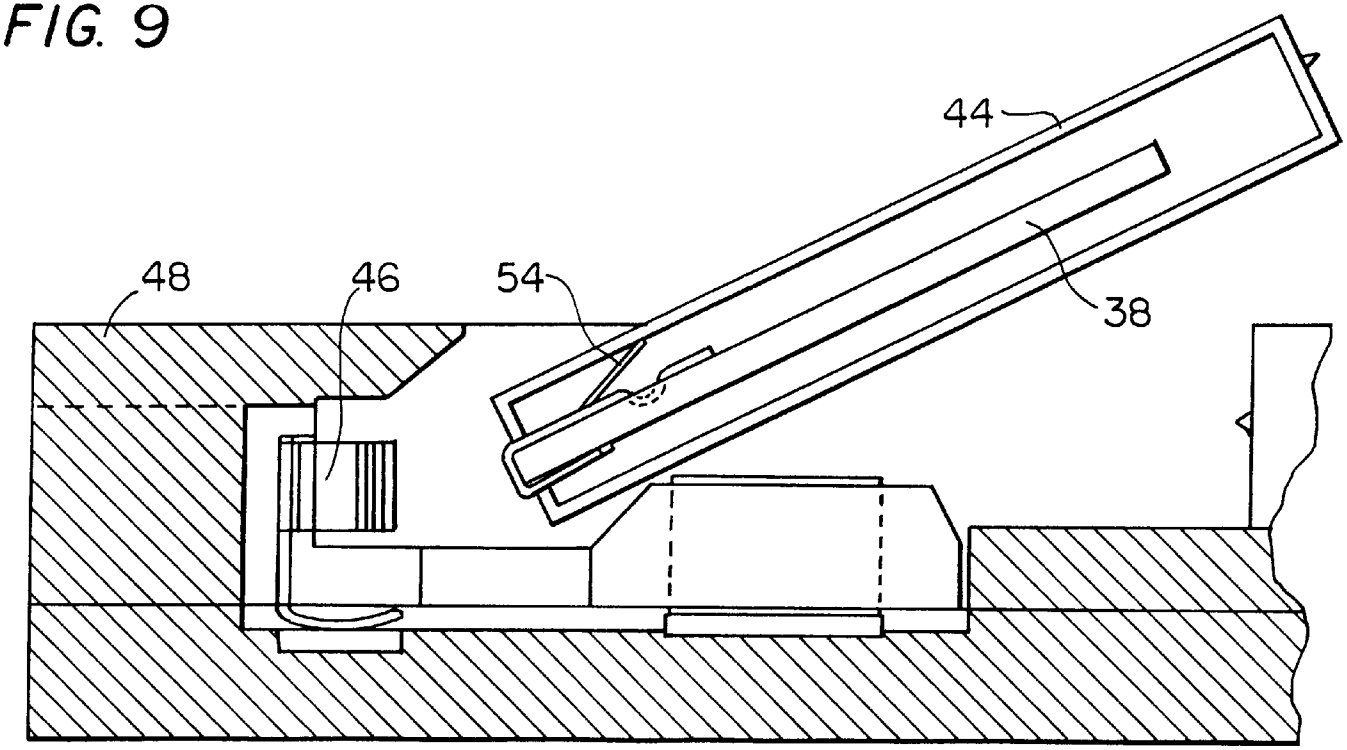
FIG. 10 is a partially cut away side view of the edge clip of FIG. 9 disposed in miniature card.

Referring now to FIGS. 3, 7, 9 and 10, for connection purposes the printed circuit board 38 is fitted into the space defined between the opposing members. In an undeflected state, i.e., before fitting to the printed circuit board, the space defined between the opposing members is less than the thickness 40 of the printed circuit board. The edge clip is preferably manufactured from a copper alloy having a thickness which exhibits both flexibility and resiliency. The planar members thus provide spring-like deflective force against the pad and printed circuit board when fitted thereto. In order to secure the edge clip in place more permanently the clip may subsequently be soldered to the pad 42.

The first and second planar members have different length dimensions in order to facilitate installation of the edge clip on the printed circuit board. In particular, the first planar member 12 is longer than the second planar member 14, thereby allowing the distal end 20 to be butted against the lower surface of the printed circuit board, after which the edge clip is rotated until the edge enters the space 18. Such a feature is useful if the space 18 at the distal end 18 is less than the thickness of the printed circuit board, since it can be difficult to press the edge clip straight onto the printed circuit board edge.

When the printed circuit board is installed in a miniature card housing 44, the connecting member disposed between the first and second opposing members can be placed in electrical connection with an external connector 46 in order to provide connectivity between the printed circuit board an external device 48. More particularly, as the miniature card is inserted into a host device the edge clip contacts the external connector, which deflects to provide secure and reliable connection.

As shown in FIGS. 1–4, 9 and 10, the edge clip may also include alignment features for facilitating alignment of the edge clip with respect to the printed circuit board pad. Each alignment feature is an interlocking protrusion 50 and recess 52 which are configured to align and securely interlock. While the protrusion may be formed on either the printed circuit board or the edge clip, in the preferred embodiment the protrusion is formed on the metal edge clip legs by bending or stamping to provide bumps which will align with the corresponding holes drilled in the printed circuit board.

The edge clip may also include a center beam 54 which extends away from the clip to provide electrical contact with a feature other than the printed circuit board pad and the external contact. For example, the center beam can be employed to deflect against a conductive miniature card housing to provide protection against damaging static discharge. The center beam extends angularly upward from the first planar member in order to provide such connection. More particularly, the center beam extends at an angle relative to the first planar member which will allow deflection against the conductive housing.

Figure 11:
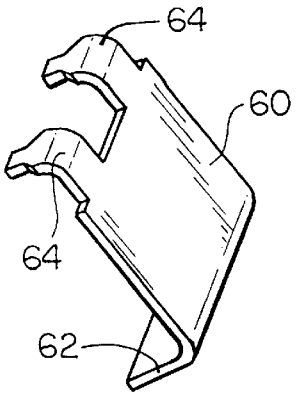
FIGS. 11 and 12 are perspective views of a second alternative edge clip.
Figure 12:
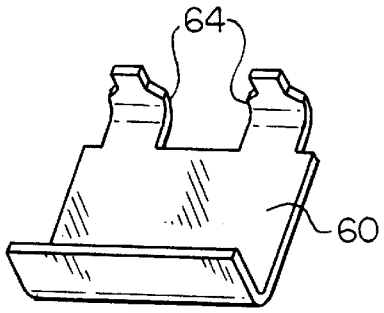
Figure 13:
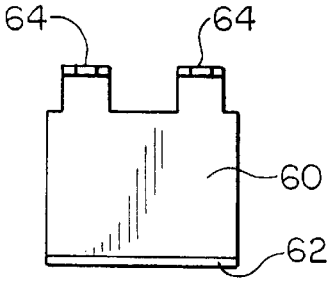
FIG. 13 is a bottom view of the second alternative edge clip.
Figure 14:
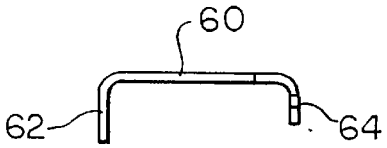
FIG. 14 is a side view of the second alternative edge clip.
Figure 15:
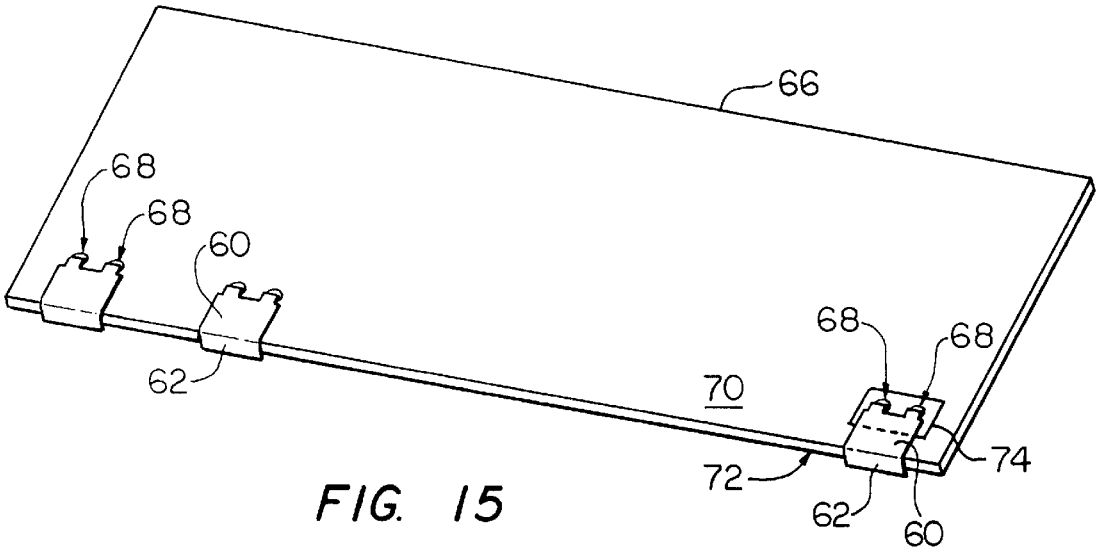
FIG. 15 is a perspective view illustrating installation of the second alternative edge clip on a printed circuit board.

A second, surface mountable alternative embodiment of the edge clip is illustrated in FIGS. 11–15. The second alternative edge clip includes a planar body section 60 having a planar edge section 62 and two location leads 64 extending from distal ends thereof. The planar edge section 62 and the body section 60 are approximately perpendicular and are connected by a rounded edge. The leads 64 and the body section 60 are also approximately perpendicular and connected by a rounded edge. Each lead 64 includes a width dimension that decreases at a portion of the lead distal from the body section 60.

The location leads 64 facilitate positioning the edge clip on a printed circuit board 66 for surface mount type installation. More particularly, position locating holes 68 are drilled in the printed circuit board 66 prior to installation of the edge clip. The edge clip is then mounted vertically on the printed circuit board such that the location leads 64 are inserted into the locating holes 68, the body section 60 is parallel to the surface 70 of the printed circuit board, and the planar edge section 62 is proximate to the edge 72 of the printed circuit board. Vertical mounting allows use of a "pick and place" machine installation. For example, a layer of paste may be placed on pad 64 and the pick and place machine can put the edge clip in place on the paste for soldering. The edge clip is then connected to the printed circuit board by soldering means such as infrared reflow. The alignment leads 64 maintain edge 62 in position relative to the edge of the printed circuit board during reflow.

In order to connect the edge clip to the printed circuit board, the holes 68 may be plated through such that the location leads are soldered to the printed circuit board. Such connection may also optionally serve to electrically connect the edge clip to components mounted on the printed circuit board. Alternatively, a conductive pad 74 may be disposed on the surface of the printed circuit board proximate to the location leads 64 and body section 60. The body section and/or lead may then be soldered to the pad.

Other alternative embodiments and modifications of the above described edge clip will be apparent to those of skill in the art. It will therefore be appreciated that the present invention is not to be viewed as limited to the specific embodiments described herein, but rather should be viewed as limited only by the spirit and scope of the appended claims.

What is claimed is:

1. An edge clip for electrically connecting a conductive pad disposed on a printed circuit board surface to an external contact proximate to the printed circuit board edge, the printed circuit board having a predetermined thickness dimension, comprising:

a first planar member formed from a resilient conductive material;

a second planar member connected to said first planar member by a connecting member, said first and second planar members being non-parallel and defining a space therebetween which decreases from a point adjacent said connecting member to a point at ends of said first and second planar members which are distal from said connecting member, said space defined between the ends of said planar members in an undeflected state being less than the thickness of the printed circuit board, first and second legs extending from said first planar member to respective ends; and a center beam which extends angularly away from said first planar member;

whereby, for connection purposes, the printed circuit board is fitted into said space such that said first and second planar members provide spring-like deflective force against the pad and the printed circuit board, thereby providing a more reliable connection, and further whereby said connecting member disposed between said first and second planar members can be placed in electrical connection with at least one external contact in order to provide connectivity between the pad and the at least one external contact.

2. The edge clip of claim 1 further including first and second scored sections disposed at the ends of said first and second legs, respectively.

3. The edge clip of claim 2 further including first and second protrusions disposed on said first and second legs, respectively, said protrusions formed to interlock with holes disposed in the printed circuit board.

4. The edge clip of claim 1 wherein said first and second planar members have different length dimensions, said first planar member having a longer length dimension than said second planar member.

5. The edge clip of claim 1 wherein said first and second planar members have different length dimensions, said second planar member having a longer length dimension than said first planar member.

6. The edge clip of claim 1 wherein said edge clip is formed from a copper alloy having a thickness which exhibits both flexibility and resiliency, whereby said planar members can be deflected.

7. The edge clip of claim 1 wherein said edge clip is stamped from a plated copper sheet.

8. An edge clip for electrically connecting a conductive pad disposed on a printed circuit board surface to an external contact proximate to the edge of the printed circuit board, the printed circuit board having a plurality of alignment holes and a predetermined thickness dimension, comprising:

a first planar member formed from a resilient conductive material;

first and second legs extending from said first planar member to respective ends thereof, said first and second legs including first and second scored sections disposed at ends of said first and second legs, respectively, said first and second legs including first and second protrusions disposed thereon, respectively, such that said protrusions interlock with the alignment holes disposed in the printed circuit board;

a second planar member connected to said first planar member by a connecting member, said second planar member having a smaller length dimension than said first planar member, said first and second planar members being non-parallel and defining a space therebetween which decreases from a point adjacent said connecting member to a point at ends of said first and second planar members which are distal from said connecting member, said space defined between ends of said planar members in an undeflected state being less than the thickness of the printed circuit board; and a center beam which extends angularly away from said first planar member to provide electrical contact with a feature other than the printed circuit board pad and the external contact, whereby, for connection purposes, the printed circuit board is fitted into said space such that said first and second planar members provide spring-like deflective force against the pad and the printed circuit board, thereby providing a more reliable connection, and further whereby said connecting member disposed between said first and second planar members can be placed in electrical connection with the external contact in order to provide connectivity between the pad and the external contact.

* * * * *